US008640929B2

(12) United States Patent
Pouliaude et al.

(10) Patent No.: US 8,640,929 B2
(45) Date of Patent: Feb. 4, 2014

(54) FLUID DISPENSER MEMBER

(75) Inventors: Florent Pouliaude, Fouqueville (FR); Sophie Feschet-Magdelaine, Evreux (FR)

(73) Assignee: Aptar France SAS, Le Neubourg (FR)

( * ) Notice: Subject to any disclaimer, the term of this patent is extended or adjusted under 35 U.S.C. 154(b) by 179 days.

(21) Appl. No.: 13/062,118

(22) PCT Filed: Sep. 1, 2009

(86) PCT No.: PCT/FR2009/051648
§ 371 (c)(1),
(2), (4) Date: Mar. 31, 2011

(87) PCT Pub. No.: WO2010/026336
PCT Pub. Date: Mar. 11, 2010

(65) Prior Publication Data

US 2011/0186601 A1 Aug. 4, 2011

(30) Foreign Application Priority Data

Sep. 3, 2008 (FR) ..... 08 55907

(51) Int. Cl.
*B67D 7/58* (2010.01)

(52) U.S. Cl.
USPC ..... 222/382; 222/464.1

(58) Field of Classification Search
USPC ..... 222/464.1, 78, 382
See application file for complete search history.

(56) References Cited

U.S. PATENT DOCUMENTS

| | | | | |
|---|---|---|---|---|
| D243,817 | S * | 3/1977 | Cloyd | D7/300.2 |
| 6,276,566 | B1 | 8/2001 | Zaksenberg | |
| 6,729,500 | B1 * | 5/2004 | Dobbs et al. | 222/78 |
| D492,197 | S * | 6/2004 | Pearson et al. | D9/451 |
| 6,918,510 | B2 * | 7/2005 | Bitton | 222/78 |
| 7,578,418 | B2 * | 8/2009 | Milian | 222/321.9 |
| 7,690,531 | B2 * | 4/2010 | VanGordon et al. | 222/78 |
| 2001/0045435 | A1 | 11/2001 | Bitton | |
| 2004/0217126 | A1 * | 11/2004 | Lee | 222/78 |
| 2005/0269352 | A1 | 12/2005 | Bitton | |

FOREIGN PATENT DOCUMENTS

FR 2877324 A1 5/2006

* cited by examiner

*Primary Examiner* — Paul R Durand
*Assistant Examiner* — Donnell Long
(74) *Attorney, Agent, or Firm* — Sughrue Mion, PLLC

(57) ABSTRACT

A fluid dispenser member (2), such as a pump, including a body (21) that is provided with an inlet sleeve (22) that defines an axis X, a dip tube (3) having an end (31) that is fitted in the inlet sleeve (22), and a decorative unit (7) including a decorative element (72) that extends in the proximity of the dip tube (3). The unit also includes a support member (71) that is fastened around the inlet sleeve (22), the support member (71) including a reception housing (711) for receiving the inlet sleeve (22) and localized connection means (712) that are situated beside the reception housing, the decorative element (72) being connected to the support member (71) at the connection means (712).

18 Claims, 2 Drawing Sheets

Figure 6:
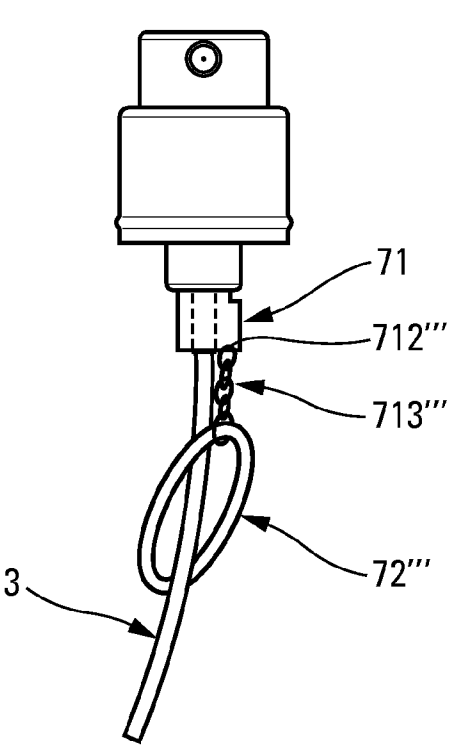

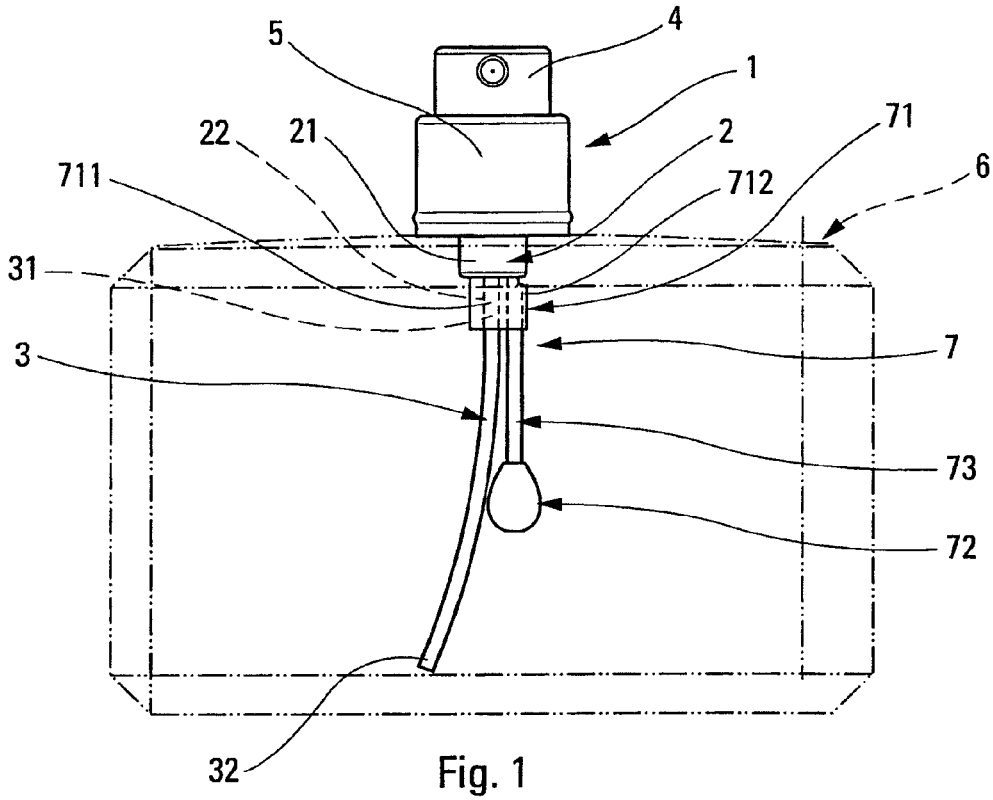
Fig. 1
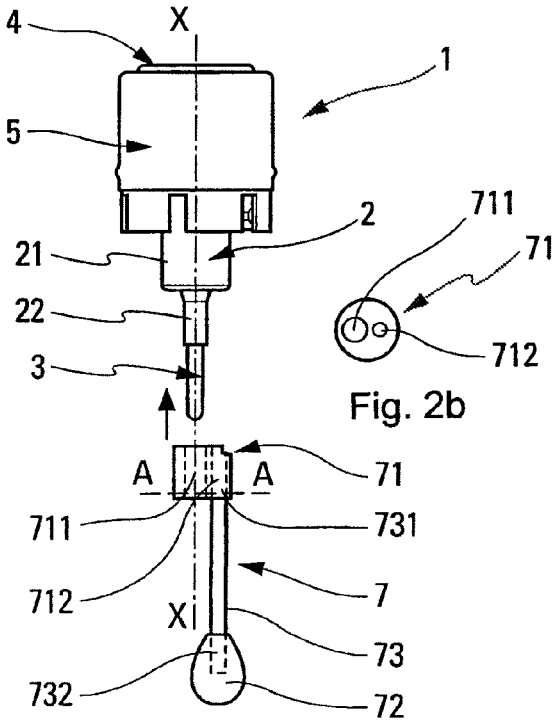
Fig. 2b
Fig. 2a
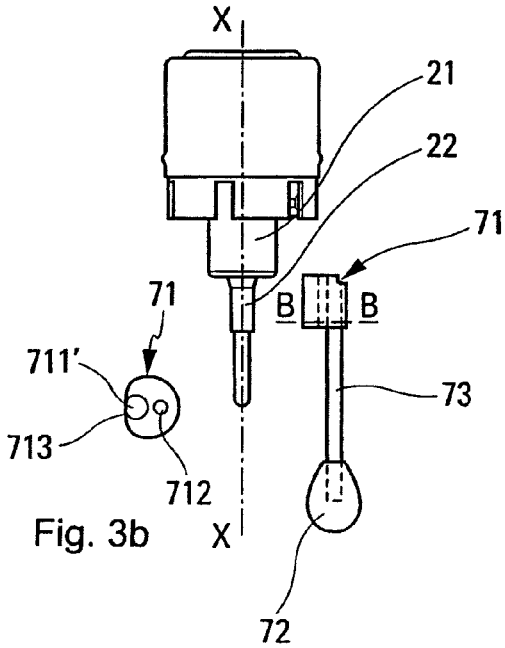
Fig. 3b
Fig. 3a

FLUID DISPENSER MEMBER

This application is a National Stage of International Application No. PCT/FR2009/051648 filed Sep. 1, 2009, which claims priority from French Patent Application No. 0855907 filed Sep. 3, 2008, the contents of all of which are incorporated herein by reference in their entirety.

The present invention relates to a fluid dispenser member, such as a pump or even a valve, for associating with a fluid reservoir so as to constitute a fluid dispenser. In addition, the present invention also relates to such a dispenser. The dispenser member comprises a body that is provided with an inlet sleeve that defines an inlet passage via which the fluid stored in the reservoir penetrates into the body of the dispenser member. The dispenser member further comprises a dip tube having a top end that is fitted in the inlet sleeve. The function of the dip tube is to deliver fluid from the reservoir to the body of the dispenser member. This is an entirely conventional design for a dispenser member, such as a pump, in the fields of perfumery, cosmetics, household cleaners, liquid soaps, or even pharmacy.

The dispenser member of the present invention further comprises a decorative unit comprising a decorative element that extends in the proximity of the dip tube, the unit further comprising a support member that is fastened around the inlet sleeve. The support member includes a reception housing for receiving the inlet sleeve.

In the prior art, already-known document FR 2 877 324 describes a cover tube that is fastened to the inlet sleeve of the dispenser member and that extends around the dip tube, surrounding it at least in part. In an embodiment of that document, a support member is fastened around the inlet sleeve, and a decorative tube is engaged on the support member in such a manner as to extend around the dip tube, masking it over a major fraction thereof. Document FR 2 877 324 consequently describes only a cover tube as a decorative element, the tube being in engagement with a support member that is fastened around the inlet sleeve, such that the tube is connected on the support member over the entire outer periphery of the support member, coaxially about the axis of the inlet sleeve. The decorative unit of that document is thus directed exclusively to providing a cover tube that masks the dip tube.

The present invention seeks to define a decorative unit that, naturally, is visible through the reservoir, and that is not exclusively for covering or masking the dip tube. The decorative element of the present invention is more generally for decorating the inside of the reservoir, optionally in combination with the dip tube. Another object of the present invention is to depart from the cylindrical or coaxial design that makes it possible merely to surround the dip tube.

To achieve these objects, the present invention proposes a fluid dispenser member, such as a pump, comprising: a body that is provided with an inlet sleeve that defines an axis X; a dip tube having an end that is fitted in the inlet sleeve; and a decorative unit including a decorative element that extends in the proximity of the dip tube, the unit also including a support member that is fastened around the inlet sleeve, the support member including a reception housing for receiving the inlet sleeve; the support member further including discrete or localized connection means that are situated beside the reception housing, the decorative element being connected to the support member at the connection means. The term "connection means" should be understood to mean any type of mechanical structure that enables the decorative element to be connected or fastened directly, or indirectly by means of a connection element. The term "connection means" should also be understood to mean any means for forming a connection, e.g. by molding, by adhesive-bonding, by heat-sealing, etc. In other words, the present invention defines a decorative unit comprising a support member that is fastened around the inlet sleeve, and a decorative element that is connected directly or indirectly to the support member via connection means that do not extend around the support member or the inlet sleeve, but, on the contrary, that are situated beside the inlet sleeve without extending around said sleeve. The connection means may also be defined as being connected to the support member in discrete manner. Advantageously, the connection means are situated in off-center manner relative to the axis X, such that they do not extend around the inlet sleeve. Thus, it can readily be understood that the connection means of the support member do not form a connection of the cylinder type around the sleeve, but, on the contrary, a connection that can be described as localized, in the sense that it does not extend around the sleeve. The support member may thus include a single localized connection, or even a plurality of connections that may be distributed around the reception housing of the support member. However, the connection points remain distinct and separate from one another.

In an advantageous embodiment, the decorative element is connected to the connection means indirectly by means of a connection element that is advantageously transparent, including a top end that is connected to the connection means and a bottom end that is connected to the decorative element. In some configurations, the connection element may form an integral part of the decorative element or of the support member. In other configurations, the connection element may be made out of a transparent material, so as to decouple the decorative element visually from its support member. The decorative element thus gives the impression of floating inside the reservoir. In a variant, the decorative element is connected directly to the connection means. In this configuration, there is no connection element, and the decorative element is connected in substantially localized manner to the support member just beside the dip tube. In general, given that the decorative element is connected to the support member that is fastened around the inlet sleeve, the decorative element extends, in most configurations, adjacent to, or in the proximity of, the dip tube. It may also be envisaged that the decorative element extends around the dip tube without being fastened thereto.

In another advantageous aspect of the present invention, the reception housing surrounds the inlet sleeve over its entire periphery, such that the support member is engaged axially on the sleeve. The reception housing thus presents a closed, cylindrical configuration, and the only way of engaging it on the inlet sleeve is to engage it axially. In a variant, the reception housing may include a side-access passage, so that the support member is engageable sideways by deforming elastically around the sleeve. With this design, it is not necessary to thread the support member up around the dip tube in order to reach the inlet sleeve. Engagement is performed sideways by snap-fastening the support member around the inlet sleeve. The side-access passage should be sufficiently open and should present appropriate elasticity so as to be able to pass around the inlet sleeve and then clamp it in appropriate manner so as to provide suitable fastening.

In a practical embodiment, the connection means comprise a connection housing into which the top end of the connection element is inserted. The connection means are thus in the form of a mechanical structure that enables the top end of the connection element to be fastened in the connection housing by clamping.

In another aspect of the present invention, the connection means comprise a plurality of discrete connection points that are advantageously situated in diametrally-opposite manner about the axis X. Thus, by way of example, there may be a plurality of connection housings that are distributed around the reception housing, the connection housings being connected directly or indirectly to one or more decorative elements. Although they are connection housings, they may be referred to as connection points, given that they do not extend around the inlet sleeve. By way of example, it is possible to devise connection points in the form of junctions obtained by molding. The connection points may also be made by adhesive-bonding or by heat-sealing. Over-molding and bi-injection may also be used to form the connection points. This is valid whether there are several connection points, or only a single connection point.

The invention also defines a fluid dispenser comprising a fluid reservoir that is completely or substantially transparent, and a dispenser member as defined above, i.e. provided with a decorative unit of the invention.

A principle of the present invention resides in using the inlet sleeve of a dispenser-member body for fastening thereto, a support member that is connected directly or indirectly to one or more decorative elements via connection points. In this way, it is possible to obtain an overall visual effect of a decorative element positioned beside the dip tube. However, the decorative element could extend around the dip tube, while being connected to the support member via one or more off-center lateral connection points.

The invention is described more fully below with reference to the accompanying drawings which show several embodiments of the invention by way of non-limiting example.

In the figures:

FIG. 1 is an elevation view of a fluid dispenser incorporating a dispenser member in a first embodiment of the invention;

FIG. 2*a* is an elevation view showing a dispenser unit ready to receive the FIG. 1 decorative unit by axial engagement;

FIG. 2*b* is a cross-section view on line AA of FIG. 2*a;*

FIG. 3*a* shows a variant embodiment of the decorative unit of FIGS. 1 and 2*a* enabling the decorative unit to be engaged sideways onto the dispenser member;

FIG. 3*b* is a cross-section view on line BB of FIG. 3*a*; and

Figure 5:
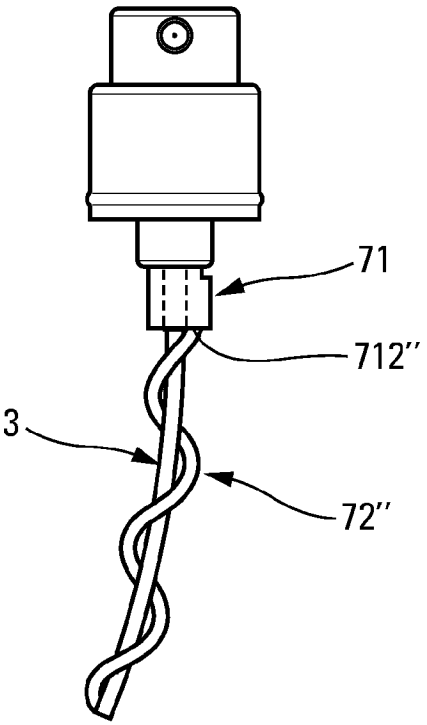
Figure 4:
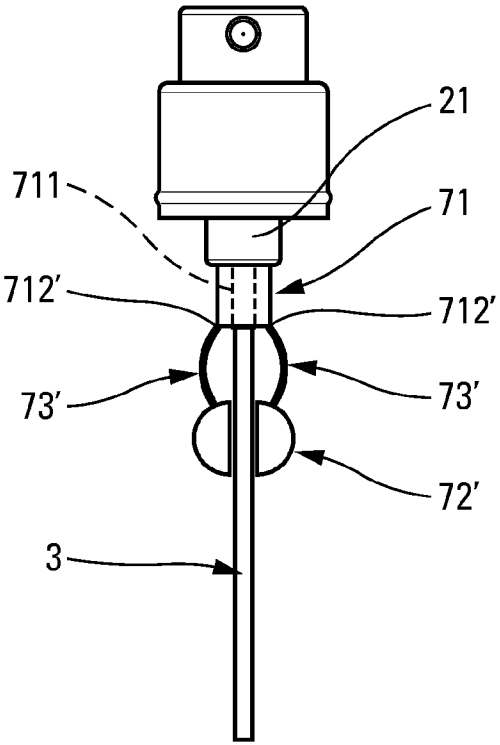

FIGS. 4, 5, and 6 are elevation views showing 2nd, 3rd, and 4th embodiments respectively of a decorative unit of the invention.

Reference is made firstly to FIG. 1 for a general description of the various component elements of a fluid dispenser of the invention. The dispenser includes a dispenser unit that is designated by the numerical reference 1. The dispenser unit 1 is associated with a reservoir 6 in such a manner as to form a fluid dispenser. The reservoir 6 is represented in diagrammatic manner only by chain-dotted lines, since it is not critical for the present invention. It is necessary only that it is substantially or completely transparent or translucent, so that it is possible to see what is contained therein. In addition, the reservoir 6 is provided with an opening, e.g. in the form of a neck on which the dispenser unit 1 may be mounted in permanent and leaktight manner. In general, necks of this type of reservoir present inside diameters that are small, and very often less than 10 millimeters (mm). Thus, it is not possible to insert any decorative element inside the reservoir.

The dispenser unit 1 comprises a fluid dispenser member 2 that is associated with a pusher 4, and that is fastened on the reservoir 6 by means of a fastener member 5. In the embodiments used to illustrate the present invention, the dispenser member 2 is a pump, but it may also be a valve, or even some other type of dispenser member. In actual fact, it suffices for the dispenser member 2 to comprise a body 21 that forms an inlet sleeve 22 in which a dip tube 3 is fitted. In conventional manner (not shown), the body 21 of the dispenser member 2 is secured to the fastener member 5 that includes appropriate means for stable and leaktight fastening on the neck of the reservoir 6. The dispenser member 2 further comprises an actuator rod (not shown) on which there is mounted the pusher 4 that incorporates a dispenser orifice, e.g. in the form of a nozzle for dispensing in the form of spray. The inlet sleeve 22 of the body 21 internally defines an inlet passage that communicates with the inside of the pump body 21 that, in conventional manner, defines a chamber in which fluid may be put under pressure before it flows through the pusher 4. In general, the inlet sleeve 22 extends along an axis X that is the longitudinal axis of revolution of the dispenser member 2. The dip tube 3 includes a top end 31 that is fitted, e.g. force-fitted, inside the inlet sleeve 22, and a free bottom end 32 that is situated in the proximity of the bottom of the reservoir 6. Thus, the fluid stored inside the reservoir 6 can be delivered into the body 21 through the dip tube 3 and the inlet sleeve 22. This is an entirely conventional design for a dispenser member, such as a pump, in the fields of perfumery, cosmetics, household cleaners, liquid soaps, etc.

In the invention, the dispenser unit 1, and more particularly its dispenser member 2, is provided with a decorative unit 7 that is fastened to the inlet sleeve 22. The decorative unit 7 comprises two essential component elements, namely a support member 71 and a decorative element 72. In the embodiment in FIG. 1, the decorative unit 7 further comprises another component element, namely a connection element 73 that may however be omitted in some embodiments, as described below. The connection element 73 makes it possible to connect the decorative element 72 to the support member 71.

Reference is also made below to FIGS. 2*a* and 2*b* in order to describe more fully the characteristics of the decorative unit 7 in this first embodiment of the invention. The support member 71 includes a reception housing 711 that, in this embodiment, is in the form of a cylindrical through passage in which the inlet sleeve 22 is force-fitted. The reception housing 711 forms a closed loop, such that the support member must be engaged axially on the inlet sleeve 22. When the dip tube 3 is already in place inside the sleeve 22, it is necessary to thread the support member 71 over the dip tube 3, then slide it until it comes into clamping engagement around the inlet sleeve 22. Once the support member 71 has been mounted on the sleeve 22, its reception housing 711 is positioned axially along the axis X. In the invention, the support member 71 also includes connection means 712 that are situated in offset or off-center manner beside the reception housing 711. In this embodiment, the connection means 712 are in the form of an axial connection housing that may have a shape similar to the shape of the reception housing 711. Consequently, the connection housing 712 may be in the form of a cylindrical through passage. It should be observed that the connection means 712 do not extend around the reception housing 711, but, on the contrary, they are positioned in localized manner beside the reception housing 711. Thus, as can be seen in FIG. 2*b*, the two housings 711 and 712 are disposed side by side. The connection element 73 includes a top end 731 that is engaged inside the connection housing 712, and a bottom end 732 that is engaged in a blind hole that is formed by the decorative element 72 that, in this embodiment, is in the form of a bead. In this embodiment, the decorative unit 7 comprises three distinct parts that are connected together. Thus, the three elements may be manufactured very easily out of different plastics materials. By way of example, the connection element 73 may be made out of a transparent plastics material.

With reference to FIGS. 3*a* and 3*b*, it is possible to see a variant embodiment of the first embodiment. The variant resides in the fact that the support member 71 is formed with a reception housing 711' that includes a side-access passage 713 enabling the support member 71 to be engaged sideways onto the inlet sleeve 22, as indicated by the arrow in FIG. 3*a*. In other words, it is not necessary to thread the support member 71 along the dip tube 3. The side-access passage 713 defines an opening that provides limited access to the inside of the housing 711'. Thus, the support member 71 may be engaged sideways onto the sleeve 22 by exerting thrust that is sufficient to deform the housing 711' elastically and momentarily, so as to snap-fasten the support member 71 around the sleeve 22. Another variant that is secondary resides in the fact that the connection element 73 is made or molded integrally with the decorative element 72.

Without going beyond the ambit of the invention, it is also possible to imagine that the connection element 73 is made integrally with the support member 71. In this configuration, the connection means are constituted by a junction obtained by molding. It is also possible to imagine that the connection element 73 is adhesively-bonded or heat-sealed to the support member 71.

FIG. 4 shows a decorative unit in a second embodiment of the invention. The support member 71 forms a reception housing 711 for the inlet sleeve 22, but it includes connection means 712' in the form of junction points obtained by molding. More precisely, the decorative unit includes a decorative element 72' in the form of a ball that is pierced with a borehole through which the dip tube 3 passes. The ball is not mounted in clamping engagement on the dip tube 3. In order to connect the ball to the support member 71, two tabs 73' are provided that act as connection elements. The top ends of the tabs 73' are connected to the support member 71 at two junction points 712' that act as localized connection means. In this embodiment, the two localized connection points 712' are situated in diametrally-opposite manner about the axis of the inlet sleeve. In a variant that is not shown, it is possible to provide only a single tab, or, on the contrary, more than two tabs, in order to connect the decorative element 72' to the support member 71. The tabs 73' may be molded integrally with the support member 71, and, in this configuration, the connection points 712' are formed merely by the junctions of the tabs with the support member 71. It is also possible to make the support member 71 and the tabs 73' by over-molding or by bi-injection. In this configuration, the junction points 712' are formed at the interface between the materials. The same applies with regard to the junctions between the tabs 73' and the decorative element 72'. They may be made as a single part, or, on the contrary, by over-molding, by bi-injection, by heat-sealing, or by adhesive-bonding.

FIG. 5 shows a decorative unit in a third embodiment of the invention. In this embodiment, the decorative element 72" is in the form of a cord or of a strip that is wound or twisted around the dip tube 3. The top end of the decorative element 72" is connected to the support member 71 at a connection point 712". In this embodiment, the connection point 712" is a single localized connection point. It may be formed using any appropriate technique, e.g. by interfitting, by adhesive-bonding, by heat-sealing, by molding as a single part, by over-molding, or by bi-injection.

FIG. 6 shows a fourth embodiment for a decorative unit of the invention. The support member 71 may be substantially identical to the support member in FIG. 5. In this embodiment, the decorative element 72'" is in the form of a ring that is threaded around the dip tube 3. The ring is connected to the support member 71 via a small segment of chain 73'". The top end of the chain is connected to the support member 71 at a localized connection point 712'" using any appropriate technique.

In certain embodiments, and by way of example, it is possible to use a dip tube that is made out of a transparent plastics material, such that it is not visible inside the reservoir.

In all of the embodiments of the invention, the decorative element is connected to the support member directly, or indirectly (by means of a connection element), via localized connection means that are situated beside the reception housing for receiving the inlet sleeve. As a function of the technique used, the connection means may be in the form of a housing, a junction point, or an adhesively-bonded, heat-sealed, over-molded, or bi-injected point. This makes it possible to make a decorative unit that is fastened independently of the dip tube, and without imparting a cylindrical or surrounding configuration thereto.

The invention claimed is:

1. A fluid dispenser member, comprising:

a body that is provided with an inlet sleeve that defines an axis X;

a dip tube having an end that is fitted in the inlet sleeve; and a decorative unit including a decorative element that extends in the proximity of the dip tube, the unit also including a support member that is fastened around the inlet sleeve, the support member including a reception housing for receiving the inlet sleeve;

the dispenser member being characterized in that the support member further includes localized connection means that are situated beside the reception housing, the decorative element being connected to the support member at the connection means, wherein the reception housing includes a side-access passage, so that he support member is engageable sideways by deforming elastically around the sleeve.

2. A dispenser member according to claim 1, wherein the connection means are situated in off-center manner relative to the axis X, such that they do not extend around the inlet sleeve.

3. A dispenser member according to claim 1, wherein the decorative element is connected to the connection means indirectly by means of a connection element that is advantageously transparent, including a top end that is connected to the connection means and a bottom end that is connected to the decorative element.

4. A dispenser member according to claim 1, wherein the decorative element is connected directly to the connection means.

5. A dispenser member according to claim 3, wherein the connection means comprise a connection housing into which the top end of the connection element is inserted.

6. A dispenser member according to claim 1, wherein the connection means comprise a plurality of discrete connection points that are advantageously situated in diametrally-opposite manner about the axis X.

7. A dispenser member according to claim 1, wherein the decorative element extends around the dip tube.

8. A dispenser comprising a fluid reservoir that is substantially transparent, and a dispenser member according to claim 1.

9. The dispenser member according to claim 1, wherein the dispensing member is a pump.

10. A fluid dispenser member, comprising:

a body provided with an inlet sleeve extending along a vertical axis;

a dip tube having an end fitted to the inlet sleeve extending from the inlet sleeve along the vertical axis; and a decorative assembly comprising a decorative element and a support member fastened to the inlet sleeve, the decorative element proximate to the dip tube and connected to the support member adjacent to the inlet sleeve so as to extend from the support member off-center relative to the dip tube, wherein the decorative element is connected to the support member by a connection element that is transparent, including a top end that is connected to the support member and a bottom end that is connected to the decorative element.

11. A dispenser member according to claim 10, wherein a reception housing surrounds the inlet sleeve over its entire periphery, such that the support member is engaged axially on the sleeve.

12. The dispenser member according to claim 10, wherein the support member comprises a reception housing that includes a side-access passage configured to engage the inlet sleeve sideways by deforming elastically around the inlet sleeve.

13. A dispenser member according to claim 10, wherein the transparent connection element is inserted into an opening in the support member resulting in the connection of the top end to the support member, the opening in the support member off-center relative to the dip tube.

14. A dispenser member according to claim 10, wherein the connection element is situated in an off-center manner relative to the axis X, so as not to extend around the inlet sleeve.

15. A dispenser member according to claim 10, wherein the top end of the connection element is insertedly disposed into a connection housing.

16. A dispenser member according to claim 10, wherein the connection element comprises a plurality of discrete connection points that are disposed in a diametrally-opposite manner about the axis X.

17. A dispenser member according to claim 10, wherein the decorative element extends around the dip tube.

18. A dispenser comprising a fluid reservoir that is substantially transparent, and a dispenser member according to claim 10.

* * * * *